US007758279B2

(12) United States Patent
Driscoll

(10) Patent No.: US 7,758,279 B2
(45) Date of Patent: Jul. 20, 2010

(54) INLAY SYSTEM FOR CONCRETE

(76) Inventor: Joe Driscoll, 801 S. 15th St., Council Bluffs, IA (US) 51501

( * ) Notice: Subject to any disclaimer, the term of this patent is extended or adjusted under 35 U.S.C. 154(b) by 51 days.

(21) Appl. No.: 12/148,991

(22) Filed: Apr. 24, 2008

(65) Prior Publication Data

US 2008/0229703 A1 Sep. 25, 2008

Related U.S. Application Data

(62) Division of application No. 11/004,580, filed on Dec. 3, 2004.

(60) Provisional application No. 60/526,551, filed on Dec. 3, 2003.

(51) Int. Cl.
*E01C 11/24* (2006.01)

(52) U.S. Cl. ..... 404/19; 404/32; 404/35; 52/747.11; 52/747.12

(58) Field of Classification Search ..... 52/747.11, 52/747.12, 177, 181, 392, 391, 315, 180; 404/15, 9, 19, 28, 29, 32, 33, 35, 36
See application file for complete search history.

(56) References Cited

U.S. PATENT DOCUMENTS

| | | | | | |
|---|---|---|---|---|---|
| 42,218 | A | * | 4/1864 | Noe | 404/21 |
| 1,264,683 | A | * | 4/1918 | Ricci | 411/456 |
| 2,153,347 | A | * | 4/1939 | Schenck | 404/21 |
| 2,326,963 | A | | 8/1943 | Morton | |
| 2,421,171 | A | * | 5/1947 | Trautvetter et al. | 52/180 |
| 4,490,069 | A | * | 12/1984 | Cushman et al. | 404/15 |
| 4,620,816 | A | * | 11/1986 | Kupfer | 404/6 |
| 4,715,743 | A | * | 12/1987 | Schmanski | 404/9 |
| 5,096,188 | A | * | 3/1992 | Shen | 482/51 |
| 5,217,319 | A | * | 6/1993 | Klohn | 404/15 |
| 5,271,690 | A | * | 12/1993 | Fennessy, Sr. | 404/9 |
| 5,303,669 | A | * | 4/1994 | Szekely | 116/205 |
| 5,328,293 | A | * | 7/1994 | Keefe | 404/9 |

(Continued)

FOREIGN PATENT DOCUMENTS

JP 05118005 A * 5/1993

OTHER PUBLICATIONS

Armor-Tile; Tactile Systems; 09614/ENG, BuyLine 9461;Engineered Plastics Inc., 300 International Drive, Suite 100, Williamsville, NY 14221; www.armor-tile.com; 4 pages.

(Continued)

*Primary Examiner*—Phi Dieu Tran A
(74) *Attorney, Agent, or Firm*—Dennis L. Thomte; Thomte Patent Law Office LLC

(57) ABSTRACT

The present invention discloses a tactile warning panel inlay system and method. Such system is comprised of a panel formed with an exposed surface having a plurality of tactile warning protrusions and a support surface configured to contact a substrate matrix. The panel includes a plurality of apertures extending from the exposed surface to the support surface. Further, a plurality of fasteners are configured to extend individually through an aperture included in the plurality of panel apertures to secure the panel to the substrate matrix. Each fastener includes a head conformed to the shape of the tactile warning protrusion and a body for extending the fastener through the panel and into the substrate matrix.

1 Claim, 3 Drawing Sheets

U.S. PATENT DOCUMENTS

| | | | | | |
|---|---|---|---|---|---|
| D382,352 | S | * | 8/1997 | Berger | D25/157 |
| D382,354 | S | * | 8/1997 | Engberg | D25/157 |
| 5,775,835 | A | | 7/1998 | Szenkely | |
| D399,011 | S | * | 9/1998 | Berger | D25/163 |
| 6,449,790 | B1 | | 9/2002 | Szenkely | |
| 6,468,678 | B1 | * | 10/2002 | Dahlin et al. | 428/800 |
| 6,709,191 | B1 | * | 3/2004 | McCuskey | 404/19 |
| 6,718,714 | B1 | * | 4/2004 | Montgomery, Sr. | 52/392 |
| 6,964,244 | B2 | * | 11/2005 | Stockton | 116/205 |
| 6,971,818 | B1 | * | 12/2005 | Schabacker | 404/19 |
| 7,000,361 | B1 | * | 2/2006 | Merriman et al. | 52/742.1 |
| 7,249,911 | B2 | * | 7/2007 | Hyams | 404/15 |

OTHER PUBLICATIONS

Hanover® Architectural Products Detectable Warning PAVER™; 240 Bender Road, Hanover, PA 17331; 4 pages.

ADA Compliant Warning and Directional Systems for the Visually Impaired; Detectable Warning Systems, Inc., 6435 Joshua Tree Ave, Orange, CA 92867; www.detectable-warning.com.

AMS Detectable Warning Systems, Tactile Surfaces; 09782/AMS, BuyLine 8289; AMS Tactile Systems, PO Box 179, North Billerica, MA 01862; Unavailable.

* cited by examiner

INLAY SYSTEM FOR CONCRETE

CROSS REFERENCE TO RELATED APPLICATION

This is a divisional application of Petitioner's earlier application Ser. No. 11/004,580, filed Dec. 3, 2004, entitled INLAY SYSTEM FOR CONCRETE.

The present application claims the benefit under 35 U.S.C. 119(e) of U.S. Provisional Application Ser. No. 60/526,551, filed Dec. 3, 2003 which is herein incorporated by reference in its entirety.

FIELD OF THE INVENTION

The present invention relates generally to the field of construction and particularly to an inlay system for concrete.

BACKGROUND OF THE INVENTION

Cement-type materials such as concrete pervade the construction industry. The durability and strength of concrete makes it particularly well suited for heavy traffic areas such as sidewalks, roadways, and the like. In addition, concrete has been utilized in nontraditional aspects of construction. For example, concrete has been utilized for countertops and other non-traditional surfaces. Concrete surface treatments may allow for various treatments to impart a pseudo stone look, pseudo brick look, and the like such as by including coloring agents and texturing the surface with stamps or the like.

Drawbacks to concrete surface treatments include the level of skill required to accomplish the task, cost, the durability of the surface, and the like. For instance, if a concrete surface is poured as a single slab, a crack in such surface may be repaired only by replacing the entire surface. In addition, concrete surface treatments are limited by the extent to which the pattern must imprint into the concrete. For example, if the difference between an upper surface and the primary (recessed) surface is too large the stamp may not provide a uniform surface or may damage the edge of a raised pattern. As a result, the project may not meet consumer desires.

Therefore, it would be desirable to develop an inlay system for concrete which allows the damaged concrete surface to be repaired without requiring the entire surface to be replaced. Further, it would be desirable for such a system to allow various types and sizes of patterns to be imprinted into concrete surfaces and yet still provide a uniform surface and not cause damage to the edge of a raised pattern.

SUMMARY OF THE INVENTION

In a first aspect of the invention, a tactile warning panel inlay system is disclosed. Such system is comprised of a panel formed with an exposed surface including a plurality of tactile warning protrusions and a support surface configured to contact a substrate matrix. The panel includes a plurality of apertures extending from the exposed surface to the support surface. Further, a plurality of fasteners are configured to extend individually through an aperture included in the plurality of panel apertures to secure the panel to the substrate matrix. Each fastener includes a head conformed to the shape of the tactile warning protrusion and a body for extending the fastener through the panel and into the substrate matrix.

In a second aspect of the invention, a method of placing a panel into a substrate matrix is disclosed. Such method is comprised of setting a panel into a substrate matrix, the panel formed with an exposed surface having a texture and a support surface configured to contact a substrate matrix. Further, the panel includes a plurality of apertures extending from the exposed surface to the support surface. Each panel is then fastened with a plurality of fasteners into the matrix, each fastener configured to extend individually through an aperture included in the plurality of panel apertures to secure the panel to the substrate matrix. The fastening of the panel with the plurality of fasteners allows a secure mechanical connection among the fastener, the panel and the substrate matrix to be formed.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
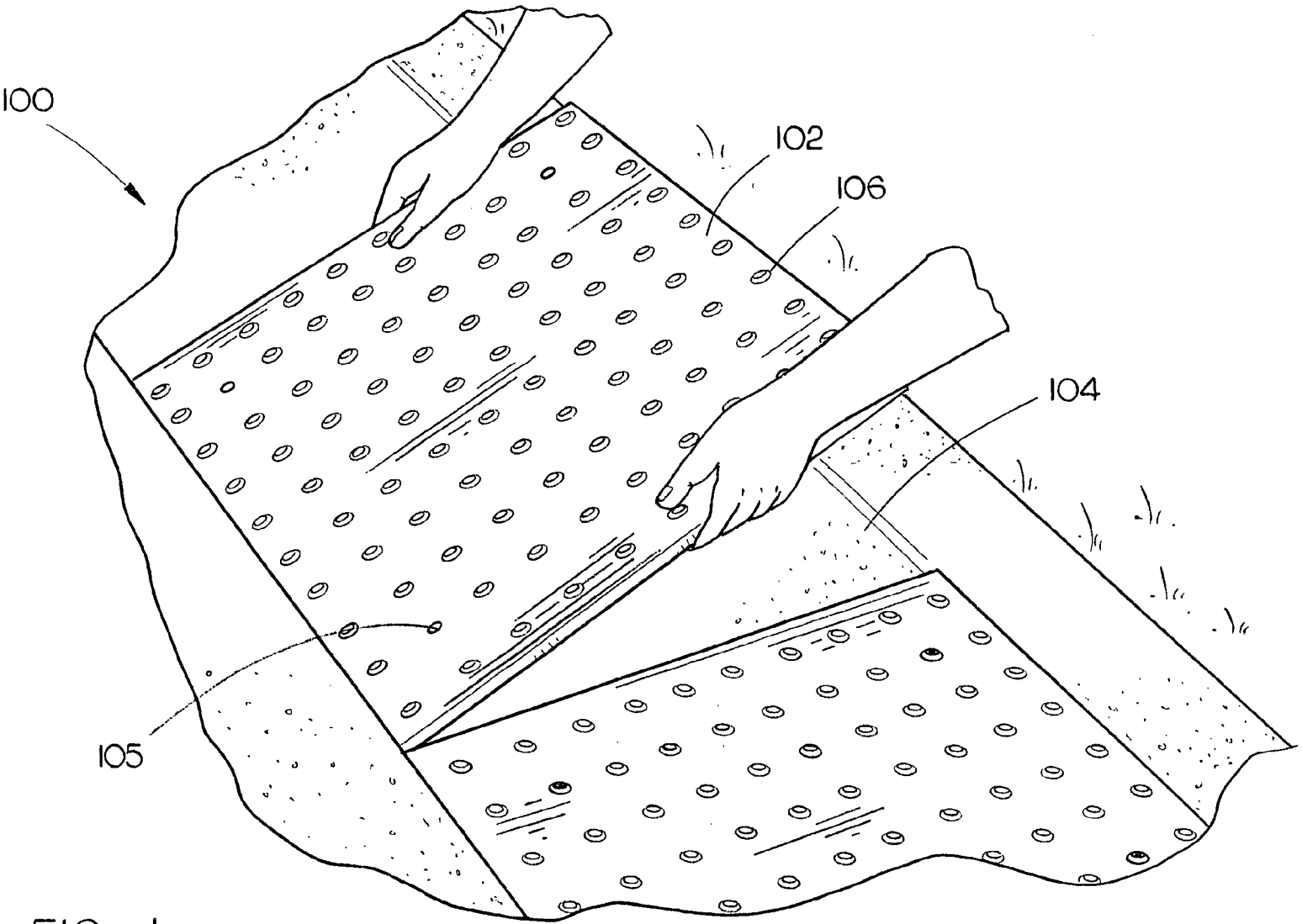
FIG. 1 is an illustration of a tactile warning panel inlay system in accordance with an exemplary embodiment of the present invention, wherein an inlay panel is being at least partially recessed into a concrete matrix.
Figure 2A:
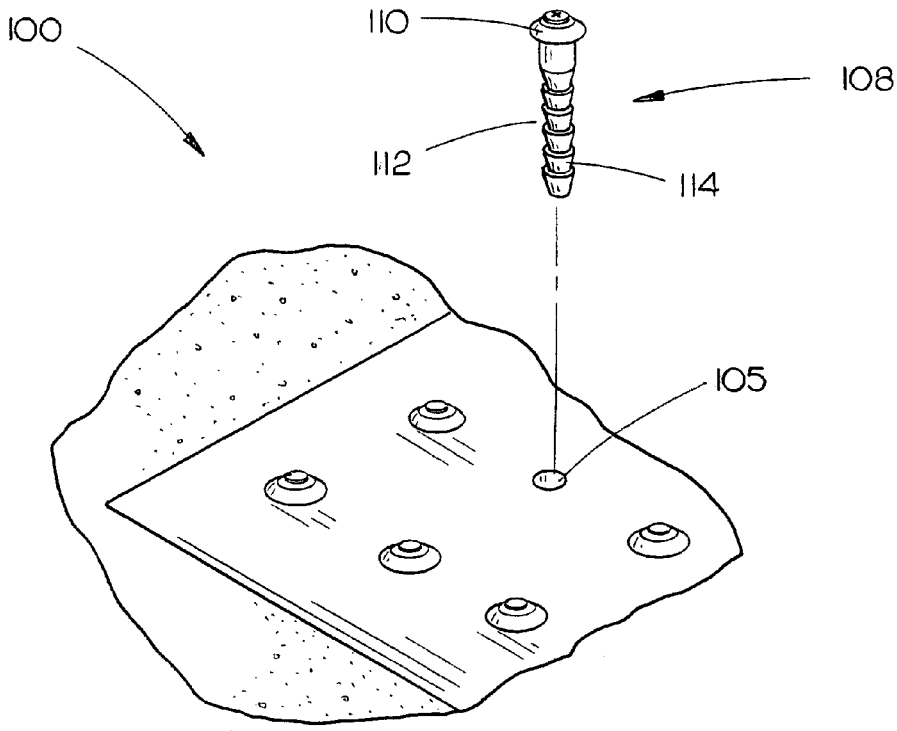
FIG. 2A is an exploded partial view of the inlay panel shown in FIG. 1, wherein a connector is employed to secure the panel to the matrix.
Figure 2B:
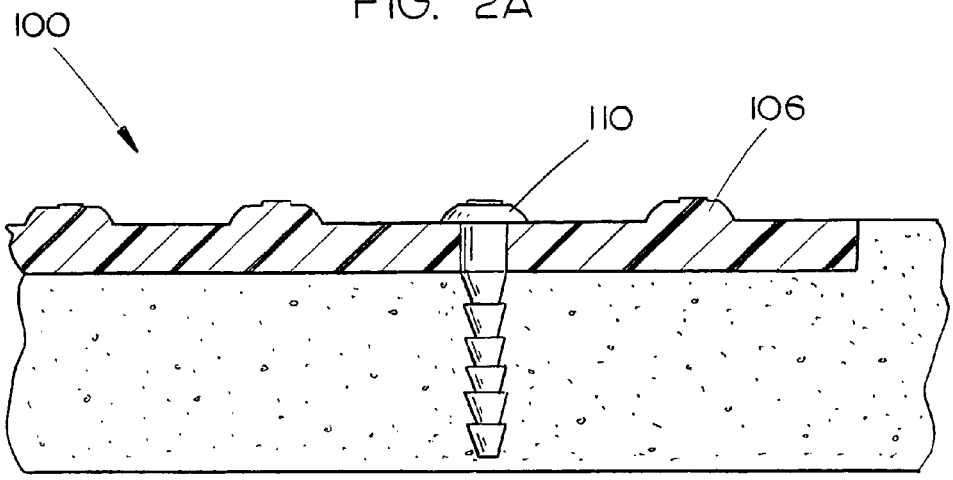
FIG. 2B is a cross-sectional side view of the inlay panel shown in FIG. 1, wherein the panel is secured to the matrix via a connector so that the connector is flush with corresponding protrusions.
Figure 3:
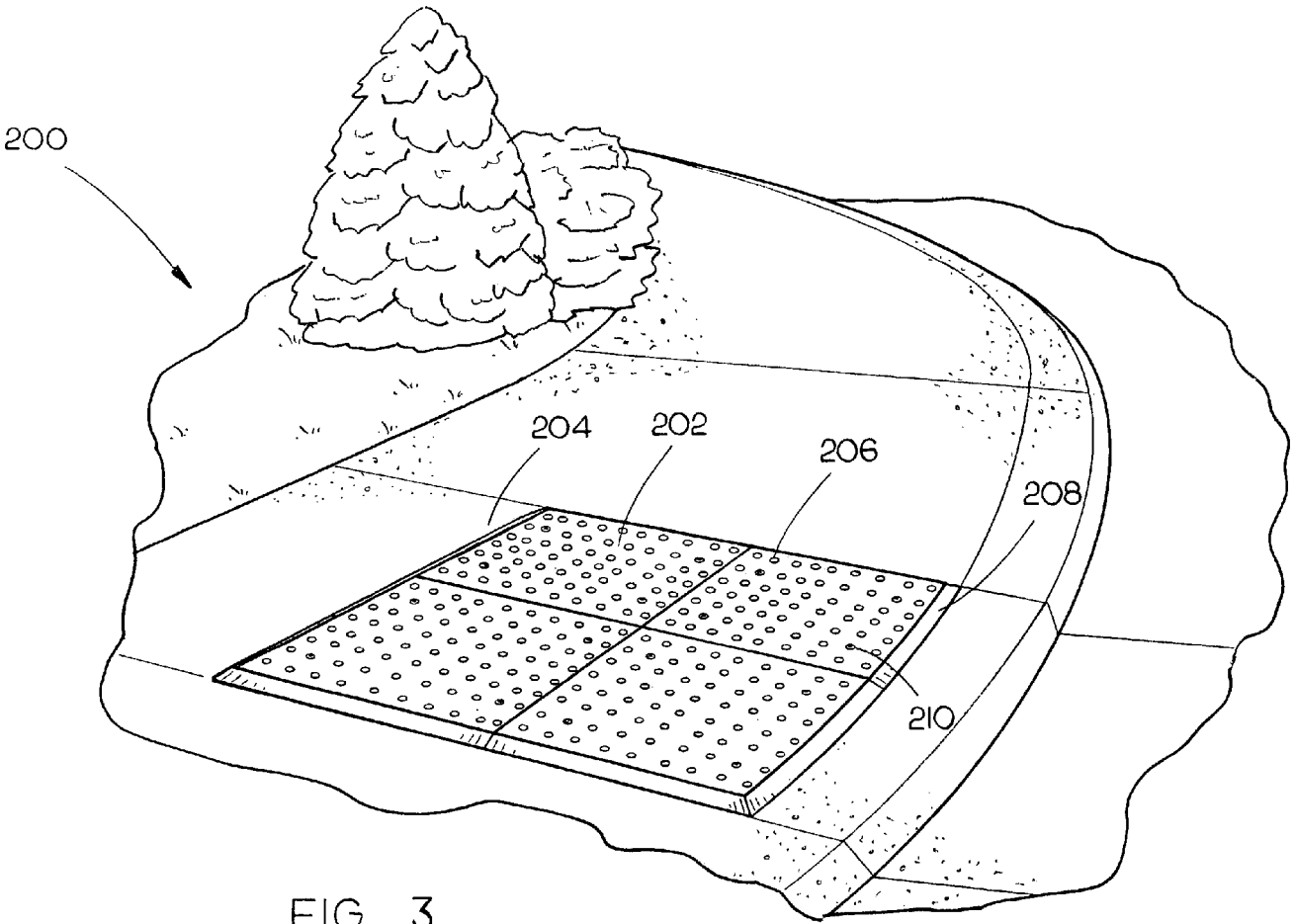
FIG. 3 is an example of retrofitting a pre-existing surface with surface panels in accordance with an exemplary embodiment of the present invention.

Referring in general to FIGS. 1-3, a panel inlay system in accordance with the present invention is disclosed. In one exemplary embodiment, the panel inlay system functions as a tactile warning system whereby panels include tactile warning protrusions. In use, the panel protrusions provide a tactile warning for the sight-impaired at intersections, cross-walks, platforms for mass transit, and the like, where tactile indicators are desired whereby such protrusions are easily detected by normal cane sweeping action. In addition, the panel protrusions may provide a tactile warning to drivers at intersections, road shoulders, and the like. In alternative embodiments, the panel inlay system may be used to provide a decorative surface such as providing a pseudo brick or stone for connection to a concrete or masonry substrate, such as for counter-top, around exposed foundations and the like. The inlay panel may allow for a greater height difference between the primary surface and the raised portion of the panel than a concrete surface treatment. For example, raised protrusions may be required to meet governmental standards when utilized for tactile indicator. In additional embodiments, other surfaces may be formed as desired.

Referring specifically to FIG. 1, a panel inlay system 100 configured to function as a tactile warning system is disclosed. An inlay panel 102 is at least partially recessed into a substrate matrix 104. In one embodiment, the substrate matrix includes concrete. In alternative embodiments, such matrix may include asphalt and the like. The inlay panel 102 includes an exposed surface and a support surface. Further, the panel 102 includes a plurality of apertures 105 extending from the exposed surface to the support surface. The exposed surface is textured while the support surface is configured to contact a substrate matrix. In the present embodiment, the exposed surface is textured with protrusions 106 in the shape of truncated dome structures. Moreover, the support surface of the panel 102 is generally smooth to allow for a difference in the expansion rates for the substrate (such as a concrete pad) versus the panel material. The forming of the panel 102 with a generally smooth support surface may also allow for ease of removal if the panel 102 should become damaged, or if replacement is desired.

In an exemplary embodiment, the panel 102 has an average thickness of approximately in the range of a ½" (a half inch) so as to minimize transport cost, promote efficient installation and the like. For instance, a 2'×2' (two foot by two foot) panel may weigh in the range of approximately 25 pounds such that the panels may be easily transported. Furthermore, the utilization of ceramic based tiles may allow for sufficient durability without increasing the weight of the panel such when compared to a panel formed entirely from a Portland cement type material. It is contemplated that those of ordinary skill in the art will appreciate that a panel may be formed in various shapes to accommodate site specifications, consumer requirements, and the like.

In an additional exemplary embodiment of the present invention, the panel 102 is formed of material suitable for coloring. For example, the inlay panel 102 may be formed of ceramic material or the like having sufficient durability and resistance to damage from freeze/thaw cycles, resistance to chemicals such as salt/calcium chloride or other chemicals for removing ice. In the previous example, the tile color may be influenced by the constituent materials, such as pink quartzite aggregate. In further examples, coloring agents such as silica encapsulated colorings (to minimize UV fading), mineral coloring agents such as iron oxides and the like are utilized. Furthermore, the ceramic matrix may include fiber for reinforcement, additives such as particles of reflecting material, accelerators, fly ash, Portland cement (to aid in set up and product appearance), anti-skid particles or other similar materials.

In additional exemplary embodiments, the surface of the panel 102 may be coated with a protective coating such as a sealant, to increase reflectivity over a standard ceramic. For instance, the panel 102 may be covered with a high durability silane sealer to minimize UV damage, resist staining, and the like. In alternative embodiments, the panel 102 may be fabricated with a high strength rating allowing panels to withstand heavy use and heavy equipment. For example, the panel 102 may be fabricated to withstand higher pressures (over that of the base substrate) or to withstand in the range of 10,000 PSI (pounds per square inch) while the base concrete material may be in the range of 4,000 PSI. In still further embodiments, reinforcing fibers may be included to increase the flexural strength of the panel 102. Suitable reinforcing materials include fiberglass, woven polymeric fibers such as spun polypropylene, and the like.

As illustrated in FIGS. 2A and 2B, the panel inlay system 100 utilizes fasteners or mechanical connectors 108 for securing the panel into the substrate matrix 104 whereby individual fasteners 108 extend through the panel 102 via panel apertures 105 to secure the panel 102 to the substrate matrix 104. In the present embodiment, each fastener 108 includes a head 110 and a body 112. Further, the fastener 108 includes a series of ribs 114 on the body 112 which assists in the fastener 108 to engage with the wet substrate matrix 104 and generate a secure mechanical connection to withstand heavy use and heavy machinery. In an exemplary embodiment, five fasteners are employed for a 2'×2' (two feet by two feet) inlay panel.

In an exemplary embodiment, the fastener 108 is generally cylindrical or conical so that should the inlay panel 102 or fastener 108 become damaged, the secured fastener 108 may be drilled-out and a replacement fastener secured via an adhesive such as an epoxy or a mortar mixture. Suitable materials for the fastener 108 include ABS (Acrylonitrile Butadiene Styrene) type plastics, polyethylene based materials, fiber reinforced plastics, such as fiber reinforced polypropylene (e.g., reinforced with fiberglass) or fiber reinforced polyester, and the like. Further, it is contemplated that suitable fastener material may be of sufficient durability to withstand snow removal operations in inclement areas and the like. While metal fasteners may be utilized, ferrous based fasteners may not have the durability, become rusted, or detract from the aesthetics of the project.

As illustrated in FIG. 2B, when the panel inlay system 100 is utilized as a tactile warning system, the head 110, included within the fastener 108, is formed to match the desired protrusion 106. In alternative embodiments, a head 110 included on a fastener 108 may be disposed in a recess or pocket in the panel so that the fastener 108 does not extend beyond a primary surface on a panel 102.

In additional embodiments, the present invention may allow for pre-existing substrates to be retrofitted with panels without having to replace the substrate. In one embodiment, the pre-existing substrate is retrofitted with the panel inlay system 100 by creating a recess of the desired depth in the substrate by grinding such area or subjecting the desired area to an acid/chemical treatment. Following such action, the inlay panels 102 are recessed into the substrate 104 as discussed above.

Alternatively, as illustrated in FIG. 3, the panel inlay system 200 is employed to retrofit a pre-existing surface with the desired panels in which a surface panel 202 is secured directly to a surface 204 without recessing or inlaying the panel 202 into the surface 204. In such embodiment, the surface panel 202 includes an exposed surface and a support surface, the exposed surface may be textured. In the present embodiment, the texture of the exposed surface includes protrusions 206. Further, the support surface is configured to contact the pre-existing surface. In one embodiment, the surface of the support surface is smooth allowing for panels to be easily removed if desired and a flush fit with the pre-existing surface to be obtained. In addition, the surface panel 202 includes a plurality of apertures 210 extending from the exposed surface to the support surface. In alternative embodiments, the surface panel 202 interlocks with additional surface panels via a flange and a lip assembly.

The surface panel 202 is placed on the desired surface 204 and then coupled to such surface. In an exemplary embodiment, surface panel 202 is coupled to the surface 204 via a plurality of connectors or mechanical fasteners (as described above) via the placement of the connectors or mechanical fasteners in the plurality of apertures 210 present within the surface panel 202. In additional embodiments, surface panel 202 may be attached to the surface 204 via adhesive or mortar mixture. Adhesive or mortar mixture may be used in addition to or in lieu of the connectors. Further, such agents may be place within the apertures 210 and/or on the support surface of the surface panel 202.

Additionally, in one embodiment, the surface panel 202 may include one or more tapered or beveled edges 208. In the present embodiment, the beveled edges 208 are located around the outer most edges of the panel inlay system 200. In use, the beveled edges 208 allow the user to enter the panel inlay system 200 gradually thereby preventing a user from tripping. In an alternative embodiment, the surface panel 202 is graded whereby one end of the panel is approximately flush with the pre-existing surface 204 and the opposite end is at a desired elevation. For example, a graded panel inlay system may be used to direct a user to door opening areas at bus stations, train stations and the like.

In a further embodiment, a panel may be at least partially covered by a removable film or wrapper. For example, a removable plastic film may be included to prevent the exposed surface from being exposed to wet concrete prior to the concrete curing. The protective film may also include apertures or perforations corresponding to the apertures in the panel or may be configured for allowing a fastener to pierce the film. For example, a panel may be at least partially recessed into the concrete substrate, fasteners secured into apertures included in the panel, the concrete broom finished (or wood float finished or the like) and then a protective film removed from the panels. Those of ordinary skill in the art will appreciate that the exact order may be varied without departing from the scope and spirit of the present invention.

It is believed that the present invention and many of its attendant advantages will be understood by the foregoing description, and it will be apparent that various changes may be made without departing from the scope and spirit of the invention or without sacrificing all of its material advantages. The form herein before described being merely an explanatory embodiment thereof, it is the intention of the following claims to encompass and include such changes.

Further, it is understood that the specific order or hierarchy of steps in the methods disclosed are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

The invention claimed is:

1. A method of placing a tactile warning device onto a substrate matrix, comprising:

providing a tactile warning panel having an upper surface and a lower surface with the upper surface having a plurality of spaced-apart tactile warning protrusions extending upwardly therefrom and a plurality of apertures formed therein between the protrusions;

covering the panel with a protective plastic sheeting;

placing the panel on the substrate matrix;

providing a plurality of fasteners with each of the protrusions having a head portion and a body portion extending downwardly therefrom, each of the head portions of the fasteners having a diameter greater than the diameters of the apertures and with each of the head portions having substantially the same configuration as the tactile warning protrusions;

extending the body portions of the fasteners downwardly through the apertures into the substrate matrix to anchor the panel to the substrate matrix and so that the head portions of the fasteners also function as tactile warning protrusions;

removing the protective plastic sheeting after fastening the panel into the matrix with the fastener.

* * * * *